US008042518B2

(12) United States Patent
Jankovic et al.

(10) Patent No.: US 8,042,518 B2
(45) Date of Patent: Oct. 25, 2011

(54) MULTI-COMPONENT TRANSIENT FUEL COMPENSATION

(75) Inventors: Mrdjan J. Jankovic, Birmingham, MI (US); Stephen Lee Cooper, Hamtramck, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/759,972

(22) Filed: Apr. 14, 2010

(65) Prior Publication Data

US 2011/0137539 A1 Jun. 9, 2011

(51) Int. Cl.
*F02M 1/00* (2006.01)

(52) U.S. Cl. ..... 123/429; 123/518; 123/304; 123/381

(58) Field of Classification Search ..... 123/429–433, 123/518, 294, 304, 381, 574, 406.47; 73/25.04, 73/29.03, 61.62
See application file for complete search history.

(56) References Cited

U.S. PATENT DOCUMENTS

| | | | | |
|---|---|---|---|---|
| 2004/0069273 | A1* | 4/2004 | Visser et al. | 123/406.47 |
| 2005/0133013 | A1* | 6/2005 | Lippa | 123/685 |
| 2005/0247289 | A1* | 11/2005 | Visser et al. | 123/406.47 |
| 2008/0053415 | A1* | 3/2008 | Marriott | 123/549 |
| 2009/0024301 | A1* | 1/2009 | Volpato | 701/103 |
| 2009/0064767 | A1* | 3/2009 | Roth | 73/61.76 |

OTHER PUBLICATIONS

Batteh, John J. et al. "Modeling Transient Fuel Effects with Alternative Fuels." SAE Technical Paper Series. 2005. 12 pages. 2005-01-1127. SAE International; Warrendale, PA.

Batteh, John J. et al. "Analytical Assessment of Simplified Transient Fuel Tests for Vehicle Transient Fuel Compensation." SAE Technical Paper Series. 2005. 14 pages. 2005-01-3894. SAE International; Warrendale, PA.

* cited by examiner

*Primary Examiner* — John Kwon
(74) *Attorney, Agent, or Firm* — Julia Voutyras; Alleman Hall McCoy Russell & Tuttle LLP

(57) ABSTRACT

A method adjusts fuel injection to account for fuel puddling in the engine intake. The fuel is adjusted based on the ethanol content of the fuel in the puddle, and the make-up of the various fuel components in the puddle. In this way, it is possible to better account for the effects of these parameters on puddle evaporation.

11 Claims, 5 Drawing Sheets

MULTI-COMPONENT TRANSIENT FUEL COMPENSATION

TECHNICAL FIELD

The present application relates to multi-component transient fuel compensation for flex fuel vehicles.

BACKGROUND AND SUMMARY

In modern engines, the air-fuel ratio (AFR) in the cylinder may be controlled close to stoichiometry to maintain high emission conversion efficiency of the exhaust catalyst system. One of the issues that affects the accuracy of AFR regulation is that a fraction of injected fuel sticks to the port walls, in so-called "puddles." Fuel from the puddles evaporates at a rate that depends on many factors including wall temperature, manifold pressure, and fuel volatility. Engine control strategies may include compensation for the fuel-puddling (also called wall-wetting) effect, but the complexity of the underlying physics makes the strategy complicated and the calibration process time consuming. Part of the complexity is due to the varying volatility of fuels available at the pump (e.g., depending on the season and location) and the requirement that some vehicles run on flex fuels which can be a variable mixture of gasoline and ethanol ($C_2H_5OH$), with up to 85% percent of ethanol. The blending leads to different behavior of the fuel in terms of vaporization and puddle formation.

Current approaches address the physics of fuel vaporization by modeling, for example, multiple puddles, and multiple fuel components. The fuel components might include the standard gasoline components (e.g., pentane, iso-octane, etc.) as well as ethanol for flex fuel applications. Another set of approaches are based on simpler "black box" models, for which the parameters are determined by matching the model output to the observed (e.g., measured) air-fuel ratio.

The inventors of the present application have recognized a problem in such previous solutions. The multi-component, multi-puddle models are complex and typically require a significant amount of computational resources to run in real time. They are also nonlinear, and hence, not conducive for transient fuel puddle compensation. The black box models rely on numerous calibrations to attempt to compensate for the fuel-puddling. The calibrations are typically time intensive and may not effectively compensate for the port puddling effect because the physics of the process is not captured well by the simplified model. In particular, these models are not capable of tracking the fraction of ethanol in the port puddle as opposed to the fraction of ethanol in the tank. Consequently, an effective transient fuel compensation may not be achieved, thereby degrading engine emissions.

Accordingly, in one example, some of the above issues may be addressed by a method of adjusting an amount of fuel injection to an engine based on an ethanol content of fuel in a port puddle. Further, in some embodiments, the adjustment may be further based on the percent ethanol of the injected fuel. Further, in some embodiments, such an approach may include determining the amount of fuel evaporated from the puddle based on selected components of the fuel and their respective vapor pressures via a multi-component fuel model. The vapor pressures may be identified via text-book values and, hence, may be accessed via a look-up table, for example, as opposed to via calibration. By reducing the amount of calibratable tables referenced in determining a fuel injection compensation, an amount of a fuel injection may be more efficiently and rapidly determined, as described in more detail herein.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Embodiments of multi-component transient fuel compensation are disclosed herein. Such a transient fuel compensation may be utilized for adjusting an amount of a fuel injection to an engine based on an ethanol content of the fuel remaining in a port puddle from previous engine operations, as described in more detail hereafter.

Figure 1:
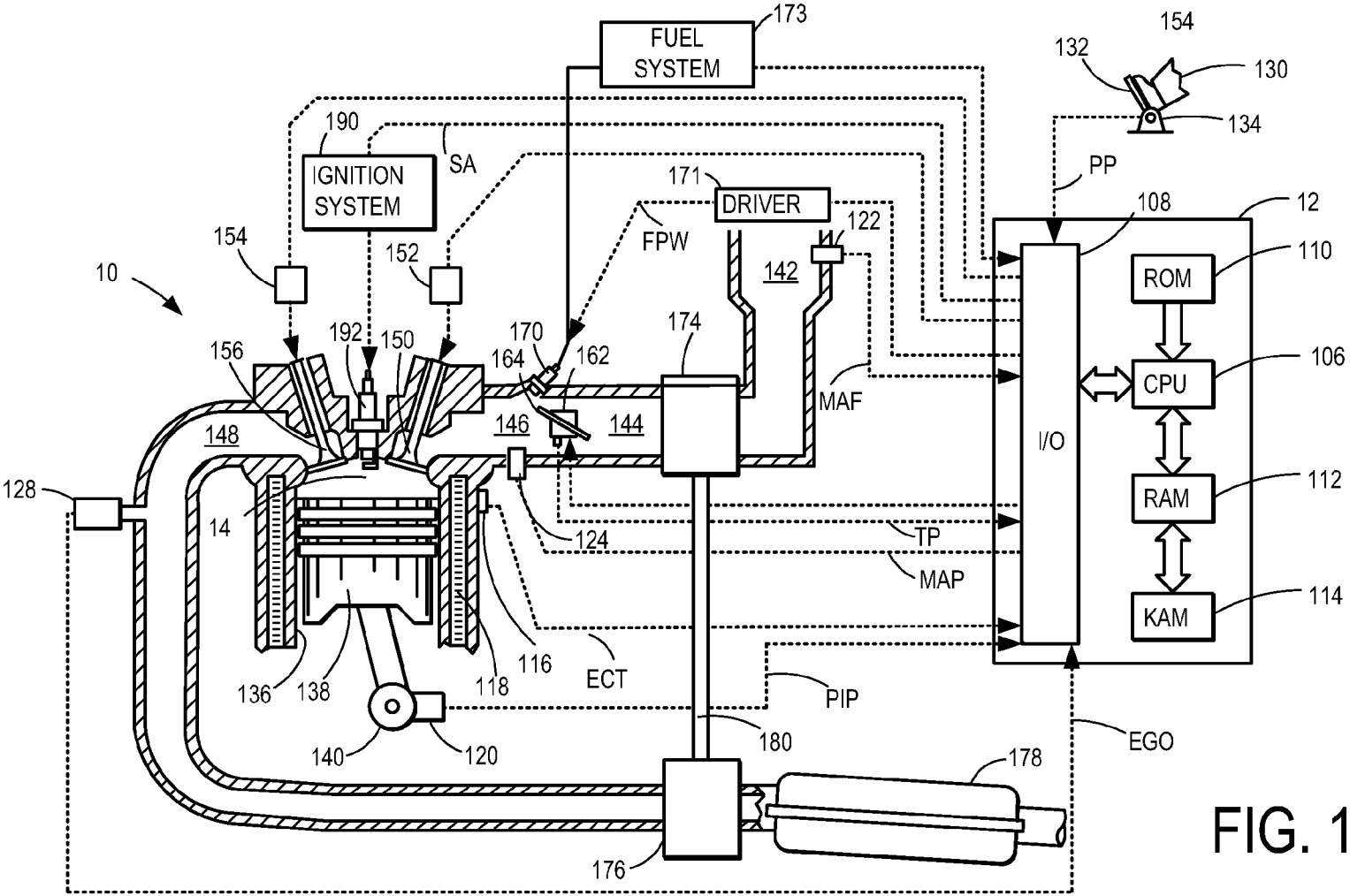
FIG. 1 shows a schematic depiction of an example engine in accordance with an embodiment of the present disclosure.

FIG. 1 depicts an example embodiment of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (also referred to as a combustion chamber) 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or may be alternatively provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be any suitable sensor for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen for example when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including a port fuel injector 170. Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel in proportion to the pulse width of signal FPW-2 received from controller 12 via electronic driver 171. Fuel may be delivered to fuel injector 170 by fuel system 173 including a fuel tank, a fuel pump, and a fuel rail. The port injected fuel may be delivered during an open intake valve event, closed intake valve event (e.g., substantially before the intake stroke), as well as during both open and closed intake valve operation.

As described above, FIG. 1 shows only one cylinder of a multi-cylinder engine. As such each cylinder may similarly include its own set of intake/exhaust valves, fuel injector(s), spark plug, etc.

Fuel tank in fuel system 173 may hold fuel with different fuel qualities, such as different fuel compositions. These differences may include different alcohol content, different octane, different heat of vaporizations, different fuel blends, and/or combinations thereof etc. In one example, fuel blends used may include alcohol containing fuel blends such as E85 (which is approximately 85% ethanol and 15% gasoline) or M85 (which is approximately 85% methanol and 15% gasoline).

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Engine 10 may further include a fuel vapor purging system (not shown) for storing and purging fuel vapors to the intake manifold of the engine via vacuum generated in the intake manifold. Additionally, engine 10 may further include a positive crankcase ventilation (PCV) system where crankcase vapors are routed to the intake manifold, also via vacuum.

Storage medium read-only memory 110 can be programmed with computer readable data representing instructions executable by processor 106 for performing the methods described below as well as other variants that are anticipated but not specifically listed.

Feedback from exhaust gas oxygen sensors can be used for controlling the air-fuel ratio. In particular, a switching type, heated exhaust gas oxygen sensor (HEGO) can be used for stoichiometric air-fuel ratio control by controlling fuel injected (or additional air via throttle or VCT) based on feedback from the HEGO sensor and the desired air-fuel ratio.

Further, a UEGO sensor (which provides a substantially linear output versus exhaust air-fuel ratio) can be used for controlling air-fuel ratio during lean, rich, and stoichiometric operation. In this case, fuel injection (or additional air via throttle or VCT) can be adjusted based on a desired air-fuel ratio and the air-fuel ratio from the sensor. Further still, individual cylinder air-fuel ratio control could be used, if desired. As described in more detail below, adjustments may be made with injector 170 depending on various factors.

Also note that various methods can be used to maintain the desired torque such as, for example, adjusting ignition timing, throttle position, variable cam timing position, exhaust gas recirculation amount, and number of cylinders carrying out combustion. Further, these variables can be individually adjusted for each cylinder to maintain cylinder balance among all the cylinders.

Fuel puddles are commonly created in intake ports of port fuel injection engines. The injected fuel can attach to the intake manifold walls after injection and the amount of fuel inducted can be influenced by intake manifold geometry, temperature, and fuel injector location. Since each cylinder can have a unique port geometry and injector location, different puddle masses can develop in different cylinders of the same engine. Further, fuel puddle mass and engine breathing characteristics may change between cylinders based on engine operating conditions. Due to the loss of fuel to the port puddle, the engine may not receive the entire amount of fuel intended to be injected by the fuel injection. However, as the fuel in the port puddle evaporates into the cylinder during an intake stroke, the engine could potentially receive too much fuel when such fuel is received in addition to a fuel injection. As such, an amount of a fuel injection may be adjusted to account for the port puddling effect.

However, not only may the physics of the fuel in the port puddle be difficult to model, but this may be further complicated by a fuel having multiple components wherein each component evaporates at a different rate since each component may have a different vapor pressure. Moreover, due to the varying volatility of flex fuels available at the pump (e.g., depending on season and location), verifying ethanol content of the fuel may further complicate modeling port puddle evaporation.

Figure 2:
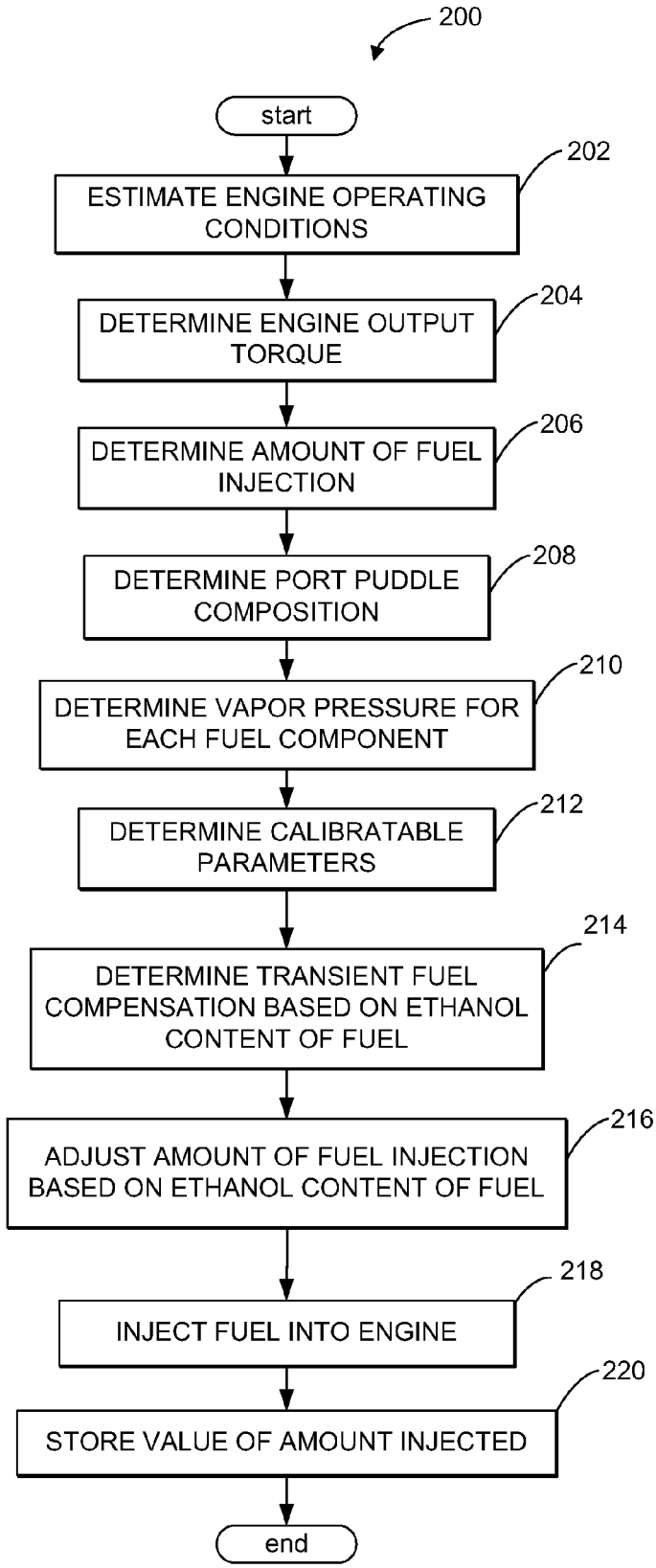
FIG. 2 shows a flow diagram of an embodiment of an example method of adjusting an amount of a fuel injection based on an ethanol content of fuel in a port puddle.

As elaborated hereafter with reference to FIG. 2, an engine controller may be configured to determine an initial, temporary, fuel injection (e.g., amount, percent ethanol, etc.), and then adjust the initial fuel injection settings to compensate for a port fuel puddle. The adjustments may be based on an amount of fuel in the fuel puddle, the composition of the fuel in the fuel puddle, vapor pressure of fuel constituents, etc. For example, an initial fuel injection may be determined based on engine operating parameters such as engine speed, engine load, engine coolant temperature, exhaust temperature, gear ratios, knock, compression ratio, boost, etc. Further, an adaptive parameter may also be included to account for learned adjustments to the fuel injection during the previous engine operation, and to account for corresponding fuel puddle dynamics. The adaptive terms may be stored in a look-up table, as a function of engine speed, load, temperature, or combinations thereof, for example. Thus, an engine controller may adjust an initial amount of fuel injection to the engine based on the ethanol content of fuel in the port puddle. For example, engine 10 may be for a flex fuel vehicle and may be configured to utilize fuel having two or more components and an ethanol content.

Controller 12 may be configured to execute instructions for adjusting an amount of a fuel injection of fuel injector 170 to engine 10. FIG. 2 illustrates an example method 200 of adjusting fuel injections to an engine. Such a method may be utilized for each cycle or event of adjusting fuel injections.

At 202, method 200 includes estimating engine operating conditions. This may include estimating an engine coolant temperature (ECT) which may be used to infer a port temperature. Other operation conditions estimated and/or measured may include, but are not limited to, engine temperature, engine speed, manifold pressure, air-fuel ratio, equivalence ratio, cylinder air amount, feedback from a knock sensor, desired engine output torque from pedal position, spark timing, barometric pressure, etc.

At 204, method 200 includes determining the desired engine output torque. In one example, the desired torque may be estimated from a pedal position signal. At 206 method 200 includes determining an amount of a fuel injection. Based on the estimated engine operating conditions and the desired torque, and further based on the transient fuel compensation history of the cylinders, an initial fuel injection setting and schedule may be determined. In one example, the controller memory may include a look-up table which may be used by the controller to determine the initial setting and schedule of fuel injection types for each cylinder or cylinder group. The initial settings may include determining a mode of fuel injection, or operating mixed-mode, (for example all port fuel injection, all direct injection, or part port fuel—part direct injection, etc.), and an initial ratio or percentage of injection between the direct injector and the port fuel injector. Other settings may include determining a timing of injection from each injector.

At 208, method 200 includes determining a composition of the port puddle. For example, the port puddle may include fuel having two or more components, where the components and make-up of the puddle fuel is different from that of the injected fuel. Examples of fuel components include, but are not limited to, ethanol, iso-pentane, iso-octane, n-decane, n-tridecane, etc. Accordingly, the components of the fuel may be identified, as well as their mass fractions of the total mass of the fuel in the puddle. Further, the fuel in the port puddle may have an ethanol content (e.g., the fuel in the port puddle includes an ethanol component), thus, 208 of method 200 may include determining the ethanol content of fuel in the port puddle. By determining the two or more components of the fuel in the port puddle, properties of each component may be utilized to determine the amount of each component of fuel evaporated from the port puddle during the intake stroke. As such, the amount of a fuel injection can then be adjusted based on the amount of fuel evaporated, as described in more detail with reference to 214.

Figure 3:
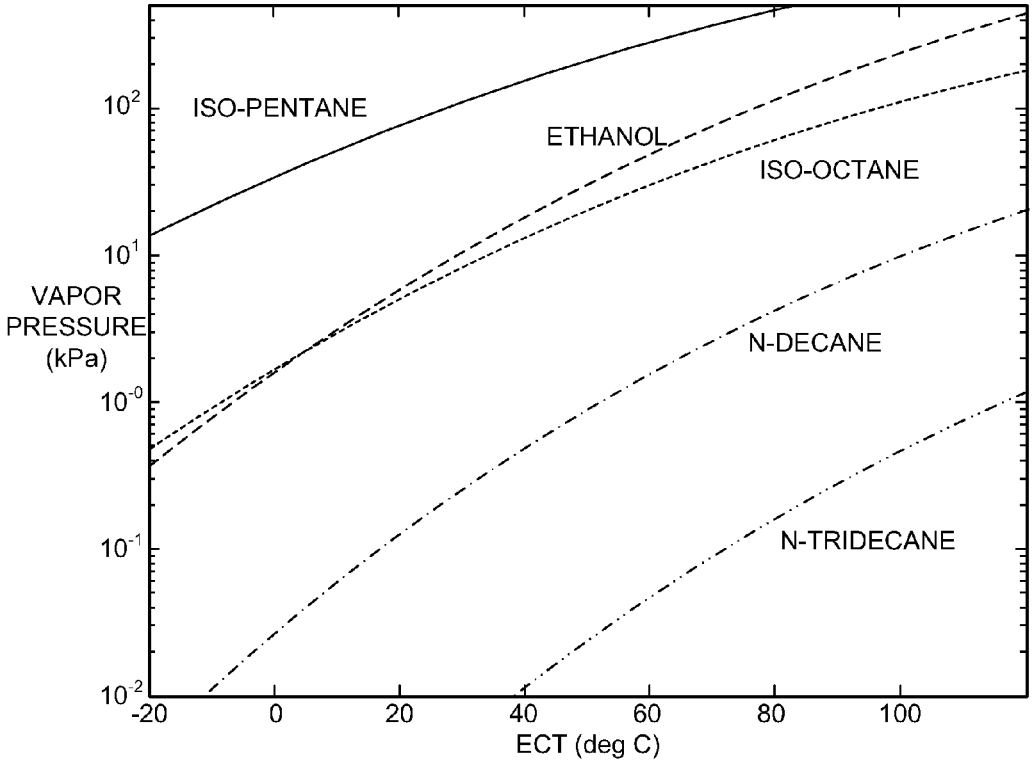
FIG. 3 shows an example of different vapor pressures for different fuel components as a function of engine coolant temperature.

At 210, method 200 includes determining a vapor pressure for the fuel components, and thus the fuel, in the port puddle. In the case that the fuel includes multiple components, each component may have a different vapor pressure, and thus a vapor pressure may be determined for each component. As an example, vapor pressures for the components may be stored in a lookup table accessible by the controller. As an example, FIG. 3 shows example vapor pressures of some typical fuel components as a function of an engine coolant temperature, for which look-up tables may be constructed. By determining the vapor pressure of the fuel in the port puddle (e.g., by determining the different vapor pressures of each of the different components of the fuel), the amount of the fuel injection can be adjusted based on the vapor pressure of the fuel, as described in more detail with reference to 214.

At 212, method 200 includes determining calibratable parameters utilized for a transient fuel compensation for adjusting the amount of the injections. This may include determining the fraction of injected fuel that hits the puddle as a function of the engine coolant temperature and/or percent ethanol, namely $\chi$(ECT, Ep). By determining the fraction of injected fuel that hits the puddle, the amount of fuel in the fuel injection may then be adjusted based on this information, as described in more detail with reference to 214. At 212, method 200 may further include determining the convective evaporation dependence on the air flow as a function of engine coolant temperature and/or percent ethanol, namely $\alpha$(ECT, Ep). Similarly, by determining the convective evaporation dependence on the air flow, the amount of fuel in the fuel injection may then be adjusted based on this information. As an example, such a convective evaporation parameter may be utilized to determine the amount of each component of fuel evaporated from the port puddle, as described in more detail with reference to 214. Further, in some embodiments determining a first parameter $\alpha$(ECT, Ep) and/or a second parameter $\chi$(ECT, Ep) may include calibrating such parameters, for example, as a function of the engine coolant temperature.

Figure 4:
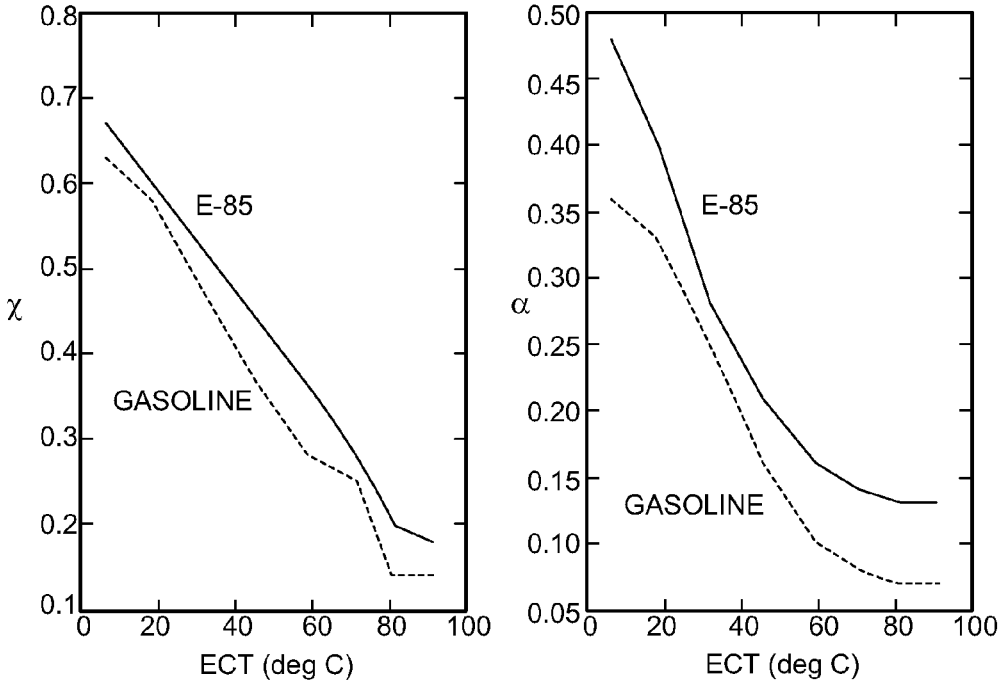
FIG. 4 shows an example of calibratable parameters in accordance with an embodiment of the present disclosure.

As an example, FIG. 4 shows example calibrations of the parameters $\chi$(ECT, Ep) and $\alpha$(ECT, Ep) as a function of engine coolant temperature and percent ethanol Ep of the freshly injected fuel. As an example, the percent ethanol may be 0% for gasoline, whereas the percent ethanol may be 85% for E85. Here, the parameter $\alpha$ is shown as scaled by the density of air. Further, in some embodiments, the values may be such that gasoline blends intermediate to that of gasoline and E85 may utilize a weighted average of the gasoline and E85 values, for example. It can be appreciated that these examples are nonlimiting, and such parameters may be calibrated differently without departing from the scope of this disclosure. By reducing the amount of parameters to be calculated, the amount of calibratable tables may be substantially reduced (for example, by a factor of more than ten compared to the conventional "black box" approach).

Returning to FIG. 2, method 200 then proceeds to 214, wherein a transient fuel compensation is determined based on the ethanol content of fuel in the port puddle. The transient fuel compensation may be determined via any suitable method. In one such suitable method, the port puddle can be modeled as a single port puddle as follows. Taking the fuel to include j components, each component can be represented with a known fraction of the total (denoted by frac_i). Examples of fuel components include, but are not limited to, ethanol, iso-pentane, iso-octane, n-decane, n-tridecane, etc. Such information may be obtained, for example, at 208. A mass of each component in the fuel puddle at intake valve opening (IVO) can be represented by a sum of the previous-cycle mass and the fraction of the newly injected fuel that hits the puddle. For example, taking k to be the event or cycle number, the mass of component i at IVO of puddle p, namely $m_p^{ivo}$_i(k), can then be represented as follows, $$m_p^{ivo}_i(k)=m_p_i(k-1)+\chi(\mathrm{ECT},Ep)\times m_{inj}(k)\times \mathrm{frac}_i,\quad i=1,\ldots,j,$$

where $m_p$–i(k−1) is the previous-cycle mass of that component, $m_{inj}$(k) is the total amount of fuel injected and $\chi$(ECT, Ep) is the fraction of injected fuel that hits the puddle.

The total puddle mass at IVO is then equal to the sum of masses of each component as follows, $$m_p^{ivo}(k)=\sum_{i=1}^{j} m_p^{ivo}_i(k).$$

At intake valve closing (IVC), the mass of puddle $m_p$ is reduced by the amount of evaporated fuel during the intake stroke. As such, in some embodiments, diffusive evaporation during the other three strokes can be neglected. The evaporated fuel can be represented as follows, $$m_{evap}(k)=m_p^{ivo}(k)\times\alpha(\mathrm{ECT},Ep)\times\ln(1+B(k)),$$

where, ECT is the engine coolant temperature which can be used as a proxy for the port temperature, $\alpha$(ECT, Ep) is a calibratable parameter that describes convective evaporation dependence on the air flow and percent ethanol, and B is the ratio of mass fractions of fuel and air. By determining the ratio of mass fractions of fuel and air, the amount of the fuel injection may be adjusted based on such a ratio, described in more detail as follows.

In this way, the rest of injected fuel is assumed to be evaporated and enter the cylinder on the intake stroke. According to the standard model, and taking the air stream to have no fuel vapor such as purge, the variable B is computed as follows. First, the total moles in the puddle can be represented as a sum of the moles of each component, $$\mathrm{mol_tot}(k)=\sum_{i=1}^{j}\frac{m_p^{ivo}_i(k)}{\mathrm{mw_i}},$$

where mw_i is the molecular weight of a component i. Taking the vapor pressure of a component i at an engine coolant temperature ECT, for example determined at 210, $$VP_i(\mathrm{ECT})=fn_\mathrm{vapor_pressure}(i,\mathrm{ECT}),i=1,\ldots,j,$$

the vapor pressure of the total puddle can then be represented as follows, $$\mathrm{VPmol_tot}(k)=\sum_{i}\mathrm{VP_i}(ECT)\times\frac{m_p^{ivo}_i(k)}{\mathrm{mw_i}}.$$

Utilizing an intermediate function as follows, $$PPair(k)=\max\left\{6[\mathrm{kPa}],\ MAP(k)-\frac{\mathrm{VPmol_tot}(k)}{\mathrm{mol_tot}(k)}\right\},$$

where MAP(k) is the manifold air pressure at cycle k, the variable B can then be represented as follows:

$$B(k)=\frac{\sum_{i}\mathrm{VP_i}(ECT)\times\frac{m_p^{ivo}_i(k)}{\mathrm{mol_tot}(k)}}{PPair(k)\times\mathrm{mw_air}}.$$

Here, mw_air is the molecular weight of air, taken to be 29 g/mol.

Note that in the above-described approach, determination of Mk) precedes that of m_evap as the latter depends on the former. Upon doing so, event or cycle k can then be completed by updating the masses of each fuel component at the end of the intake stroke accounting for the evaporated fuel as follows, $$m_{evap}_i(k) = \min\left\{ m_p^{ivo}_i(k),\ m_{evap}(k) \times \frac{\mathrm{VP_i}(ECT) \times m_p^{ivo}_i(k)}{\sum_i \mathrm{VP_i}(ECT) \times m_p^{ivo}_i(k)} \right\},$$

$$i = 1, \ldots, j$$

$$m_p_i(k) = m_p^{ivo}_i(k) - m_{evap}_i(k),\ i = 1, \ldots, j.$$

Finally, the model computed mass of fuel in the cylinder can be represented as:

$$m_{fcyl}(k) = (1 - \chi(ECT, Ep)) \times m_{inj}(k) + \sum_{i=1}^{j} m_{evap}_i(k).$$

To compute the transient fuel compensation from the multi-component model described above, it may be assumed that the composition of the puddle is not affected significantly by the difference between the mass of injected fuel from two consecutive events.

To compute the ln(1+B) term at a time instant k, as described above, the amount of injected fuel $m_{inj}$ is needed. However, this cannot be determined because $m_{inj}$ depends on the transient fuel quantity computed later in the algorithm. To resolve this issue, the above assumption is used, namely that the effect of varying mass of injected fuel between two events, or two cycles if the algorithm is run at cycle rate, has little effect on the puddle composition. Accordingly, the transient fuel compensation approach described above may be approximated in practice as follows.

First, the mass of component i at IVO of puddle p, namely $m_p^{ivo}$_i(k), can then be represented as follows, $$m_p^{ivo}_i(k) = m_p_i(k-1) + \chi(\mathrm{ECT}, Ep) \times m_{inj}(k-1) \times \mathrm{frac}_i,\quad i = 1, \ldots, j,$$

wherein the former $m_{inj}$ term has been approximated by the previous cycle value, namely $m_{inj}$(k−1). As such, the variable B(k) representing the ratio of mass fractions of the fuel and air can then be determined as follows utilizing the approach described above, wherein the ratio is based on a vapor pressure of each of the two or more components of fuel in the port puddle:

$$\mathrm{mol_tot}(k) = \sum_{i=1}^{j} \frac{m_p^{ivo}_i(k)}{\mathrm{mw_i}}$$

$$\mathrm{VP_i}(ECT) = \mathrm{fn_vapor_pressure}(i, ECT),\ i = 1, \ldots, j$$

$$\mathrm{VPmol_tot}(k) = \sum_i \mathrm{VP_i}(ECT) \times \frac{m_p^{ivo}_i(k)}{\mathrm{mw_i}}$$

$$PPair(k) = \max\left\{ 6[kPa],\ (\mathrm{inf}_)MAP(k) - \frac{\mathrm{VPmol_tot}(k)}{\mathrm{mol_tot}(k)} \right\}$$

$$B(k) = \frac{\sum_i \mathrm{VP_i}(ECT) \times \frac{m_p^{ivo}_i(k)}{\mathrm{mol_tot}(k)}}{PPair(k) \times \mathrm{mw_air}}$$

The amount of evaporated fuel from each component and the mass of each component can be determined as follows, wherein an amount of each of the two or more components of fuel evaporated from the port puddle during an intake stroke is based on the above-described ratio of mass fractions of fuel and air, and the parameter describing the convective evaporation dependence on the airflow:

$$m_{etmp}_i(k) = \alpha(ECT, Ep) \times \ln(1 + B(k)) \times \sum_{i=1}^{j} m_p^{ivo}_i(k) \times \frac{\mathrm{VP_i}(ECT) \times m_p^{ivo}_i(k)}{\sum_i \mathrm{VP_i}(ECT) \times m_p^{ivo}_i(k)},$$

$$i = 1, \ldots, j$$

$$m_{evap}_i(k) = \min\{m_{etmp}_i(k),\ m_p^{ivo}_i(k)\},\ i = 1, \ldots, j$$

$$m_p_i(k) = m_p^{ivo}_i(k) - m_{evap}_i(k),\ i = 1, \ldots, j$$

As such, the amount of a fuel injection can then be adjusted based on the ethanol content of fuel in the port puddle. More explicitly, the amount that the fuel injection is adjusted may be further based on the vapor pressure of the fuel in the port puddle, and the amount of fuel evaporated from the port puddle during the intake stroke. Moreover, since the fuel puddle composition was determined, the vapor pressure of the fuel can be based on different vapor pressures of the different components, and the amount of fuel evaporated from the port puddle may be based on the different amounts of each of the different components of fuel evaporated from the port puddle.

Since the mass of a component cannot be negative, the amount of evaporated fuel from each component is limited accordingly. As such, the final transient fuel compensation then computes the additional fuel as follows, based on the amount of each of the two or more components of fuel evaporated from the port puddle during the intake stroke and the fraction of injected fuel that hits the port puddle as a function of the engine coolant temperature and percent ethanol, $$m_{tfc}^{mc}(k) = \frac{\chi(ECT, Ep)}{1 - \chi(ECT, Ep)} m_{fdes}(k) - \frac{1}{1 - \chi(ECT, Ep)} \sum_{i=1}^{j} m_{evap}_i(k)$$

where $m_{fdes}$(k) is the amount of fuel the controller (e.g., controller 12) had determined to be needed for the appropriate in-cylinder air to fuel ratio, usually stoichiometry, at the time instant k.

Continuing with FIG. 2, at 216, method 200 includes adjusting the amount of the fuel injection based on the ethanol content. According, the transient fuel compensation determined at 214 may be used to adjust the amount of the fuel injection to account for the fuel in the port puddle which has evaporated into the cylinder during intake.

At 218, method 200 includes injecting the fuel into the engine. The amount injected could be equal to $m_{inj}$(k)=$m_{fdes}$(k)+$m_{tfc}^{mc}$(k), though other adjustment(s) could be applied before the fuel injection quantity is finally determined. At 220, the value of the amount injected may be stored, via the controller, to access during subsequent cycles of determining the transient fuel compensation. Furthermore, additional values may be stored. For example, the amount of adjusted fuel injected into the engine, the port puddle composition, etc. for a given cycle may be stored to access during subsequent cycles. Vapor pressures may also be stored, and/or values of the calibratable parameters. In some embodiments, these values may be used in subsequent cycles to update look-up tables and/or recalibrate the parameters.

Figure 5:
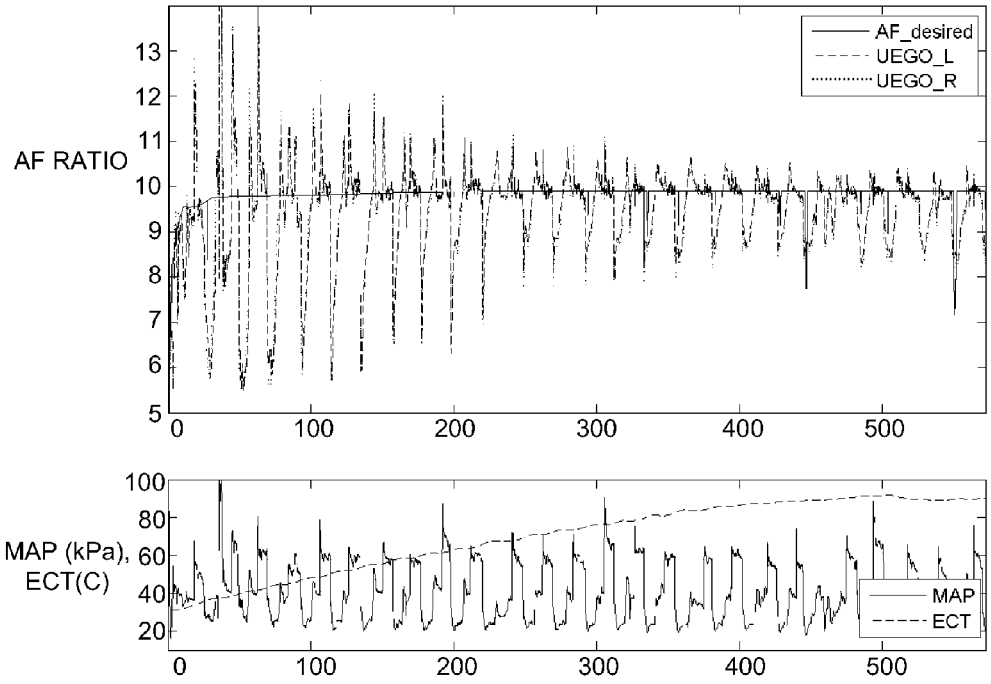
FIG. 5 shows example results for an engine running during warm-up with no transient fuel compensations.
Figure 6:
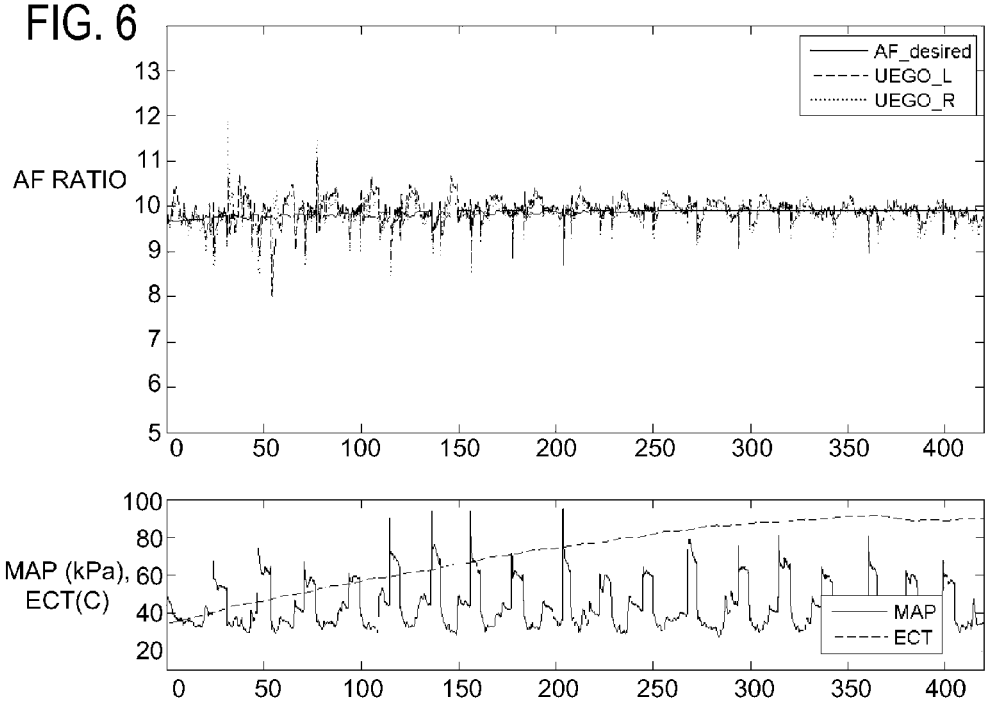
FIG. 6 shows example results for an engine with transient fuel compensation engine in accordance with an embodiment of the present disclosure.

Turning now to FIGS. 5 and 6, a comparison of performances of an example multi-component transient fuel compensator for E85 fuel is described herein. The quality of the transient fuel compensation may be determined by how close the AF ratio is maintained to a desired value. For the case of E85, the desired value is typically equal or close to 9.9, the stoichiometric value for E85.

FIG. 5 illustrates results for an engine running (e.g., accelerating and decelerating sharply) during warm-up with no transient fuel compensations. In such a case, significant deviations from the desired AF ratio are shown. Alternatively, FIG. 6 shows results with transient fuel compensation as described herein. As such, FIG. 6 illustrates an example wherein adjusting the fuel injections based on an ethanol content allows for deviations from the desired AF ratio to be substantially reduced. A similar result can be achieved for gasoline.

As one possible scenario, even though the injected fuel has a relatively high percent ethanol, due to the particular operating conditions, fuel components, temperatures, etc., the amount of a fuel injection to the engine may be reduced slightly to account for fuel in the port puddle having a relative low ethanol content (as compared to the injected fuel) which has evaporated into the cylinder during intake. As another possible scenario, even though the injected fuel may have a relatively low percent ethanol, the fuel in the port puddle may have a relatively higher ethanol content which is more likely to evaporate into the cylinder at intake. As such, the amount of a fuel injection to the engine may be reduced more significantly to account for the additional fuel in the puddle that has evaporated. Typically, at colder engine temperatures the ethanol content in the port puddle would be higher than the percent ethanol in the injected fuel, and for hotter engine temperatures the converse would be true, namely that the ethanol content in the port puddle would be much lower than the percent ethanol in the injected fuel.

In this way, by compensating for the amount of fuel from the port puddle that evaporates into the engine during an intake stroke, via the ethanol content of the puddle fuel, and the relative amount of different fuel components in the puddle, the amount of the fuel injection can be adjusted such that the AFR in the cylinder can be controlled close to stoichiometry. As such, a high emission conversion efficiency of the exhaust catalyst system can be maintained.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method of adjusting fuel injections to an engine, comprising:

adjusting an amount of a fuel injection to an engine based on an ethanol content of fuel in a port puddle, including determining a transient fuel compensation based on the ethanol content and a vapor pressure of the fuel in the port puddle and adjusting a desired amount of injected fuel based on the transient fuel compensation.

2. The method of claim 1, further comprising determining an amount of fuel evaporated from the port puddle during an intake stroke, and wherein adjusting the amount of the fuel injection to the engine is further based on the amount of fuel evaporated from the port puddle during the intake stroke.

3. The method of claim 1, wherein the fuel in the port puddle comprises two or more components, and wherein adjusting the amount of the fuel injection to the engine is further based on a vapor pressure of each of the two or more components.

4. The method of claim 3, further comprising determining an amount of each of the two or more components of fuel evaporated from the port puddle during an intake stroke, determining and storing in a computer memory an amount of each of the two or more components left in the port puddle at an end of the intake stroke, and wherein adjusting the amount of the fuel injection to the engine is further based on the amount of each of the two or more components of fuel evaporated from the port puddle during the intake stroke.

5. The method of claim 1, wherein adjusting the amount of the fuel injection to the engine is further based on a parameter describing convective evaporation dependence on an air flow.

6. The method of claim 5, further comprising calibrating the parameter as a function of an engine coolant temperature and a percent ethanol of an injected fuel.

7. The method of claim 1, wherein adjusting the amount of the fuel injection to the engine is further based on a parameter describing a fraction of an injected fuel that hits the port puddle, the method further comprising calibrating the parameter as a function of an engine coolant temperature and a percent ethanol of the injected fuel.

8. The method of claim 1, wherein an injected fuel has a percent ethanol different than the ethanol content of the fuel in the port puddle, where the amount of fuel injected is based on the percent ethanol of the injected fuel, and the ethanol content of the fuel in the port puddle.

9. The method of claim 1, wherein adjusting the amount of the fuel injection to the engine is further based on a ratio of mass fractions of the fuel and air.

10. The method of claim 1, wherein the engine is coupled in a flex fuel vehicle and is configured to utilize fuel having two or more components and a variable ethanol content.

11. The method of claim 1, wherein the fuel in the port puddle comprises two or more components, and wherein the vapor pressure of the fuel is based on a vapor pressure of each of the two or more components.

* * * * *